US005567339A

United States Patent [19]

Joo et al.

[11] Patent Number: 5,567,339

[45] Date of Patent: Oct. 22, 1996

[54] WAVE GUIDE SYSTEM OF A MICROWAVE OVEN

[75] Inventors: Phil D. Joo; Kyung S. Lim; Kwan H. Lee, all of Kyungsangnam-do, Rep. of Korea

[73] Assignee: Goldstar Co., Ltd., Seoul, Rep. of Korea

[21] Appl. No.: 64,421

[22] Filed: May 21, 1993

[30] Foreign Application Priority Data

Aug. 25, 1992 [KR] Rep. of Korea ..... 15981/1992
Mar. 8, 1993 [KR] Rep. of Korea ..... 3427/1993

[51] Int. Cl.[6] ..... H05B 6/72

[52] U.S. Cl. ..... 219/748; 219/746; 219/750; 219/697

[58] Field of Search ..... 219/10.55 F, 10.55 A, 219/10.55 R, 10.55 E, 746, 748, 750, 695, 696, 697

[56] References Cited

U.S. PATENT DOCUMENTS 4,616,119 10/1986 Shin ..... 219/10.55 F
4,733,037 3/1988 Nitta et al. ..... 219/10.55 F
5,015,813 5/1991 Yamada et al. ..... 219/10.55 F
5,057,660 10/1991 Yamada et al. .
5,177,333 1/1993 Ogasawara ..... 219/10.55 F
5,237,139 8/1993 Berg et al. ..... 219/10.55 A

FOREIGN PATENT DOCUMENTS 0478053 9/1991 European Pat. Off. .

*Primary Examiner*—Philip H. Leung
*Attorney, Agent, or Firm*—Fish & Richardson P.C.

[57] ABSTRACT

A wave guide system of a microwave oven is provided, comprising a cavity containing a food to be cooked and having a pair of microwave feed openings formed in one wall thereof; a magnetron having an antenna and positioned between the microwave feed openings in spaced apart relation to the wall having the feed openings, to generate microwaves having a wavelength of $\lambda_g$; and a waveguide provided to cover the feed openings, support thereon the magnetron and guide the microwave through the feed openings into the cavity and having a short circuited surface which is spaced apart from the antenna by a distance of $\lambda_g/4$ and parallel to the antenna. With this arrangement, the microwave generated in the magnetron produce standing waves in the waveguide, and then are emitted into the cavity through the microwave feed openings of the cavity, thereby uniformly heating a food in the cavity.

16 Claims, 9 Drawing Sheets

WAVE GUIDE SYSTEM OF A MICROWAVE OVEN

BACKGROUND OF THE INVENTION

1. Field of the Invention

This invention generally relates to a microwave oven, and more particularly a wave guide system of a microwave oven, which guide microwaves generated by a magnetron into a cavity of the oven through microwave feed openings of the wall of the cavity to heat food products placed in the cavity.

2. Description of the Prior Art

Generally, a microwave oven is a cooker for dielectrically heating food products placed in a cavity by microwaves which are generated by a magnetron, directed to a waveguide, and then emitted into the cavity to be incident upon the food products. Microwave ovens are classified into a single feed type, a dual feed type and a multiple feed type depending upon the number of a microwave feed opening for feeding the microwaves into the cavity.

One of the conventional microwave ovens of a single feed type is of the type as shown in FIGS. 1*a* and 1*b* of the accompanying drawings, which comprises a cavity 301 having an internal space and a microwave feed opening 302 formed through one side wall thereof the feed microwaves into the cavity; a tray 305 disposed centrally of the bottom of the cavity 301 to support thereon a loading, i.e., a food product and rotatably driven by a motor 306; a waveguide 303 disposed externally of the cavity 301 to surround the microwave feed opening 302 and be in communication with the feed opening; and a magnetron 304 mounted on the back of the waveguide 303.

With this construction, when electric power is applied to the microwave oven, the magnetron 304 generates microwaves, which are in turn introduced into the waveguide 303, and then emitted into the cavity 301 through the single microwave feed opening 302 of the side wall of the cavity to be incident upon the food on the rotating tray 305, thereby effecting cooking of the food through dielectrical heating action.

This prior microwave oven having the single microwave feed opening through which the microwaves pass to be directed to a food product in the cavity however has drawbacks as follows:

First, in cooking of planar, i.e., substantially flat, food products such as, for example, a laver (a kind of seaweed), a squid, a pizza and the like, uniform heating may not be achieved, so that the central portion of the food may be over-heated to be burnt black. Second, when heating food products contained in containers of a given height, such as a milk bottle, cup and the like, there may occur a phenomenon in which the upper portion of the container is more concentratively heated than the lower portion so that there exist a heating temperature difference between the upper and lower portions of the container. As a result, the heated liquid beverage such as, for example, milk, tea, Chinese medicine, or the like can give a feeling of discomfort to an eater due to the temperature difference between the upper and lower areas of the liquid beverage in the container. Third, since a food product is not heated uniformly as a whole, it is necessary to extend the cooking time in order to additionally cook the insufficiently heated portion, resulting in increasing power consumption.

Accordingly, with a view to overcoming the problems caused by the microwave oven of a single feed type as described above, there have been proposed microwave ovens of a dual feed type having two microwave feed openings formed in a side wall of a cavity, typical examples of which are disclosed in U.S. Pat. No. 5,057,660 and European Patent Publication No. 0,478,053.

The prior art microwave ovens of a dual feed type as disclosed in the above mentioned patents will now be summarized with reference to FIGS. 2*a*, 2*b*, 3*a*, and 3*b* of the accompanying drawings.

First, referring to FIGS. 2*a* and 2*b* showing longitudinal cross-sectional and exploded fragmentary perspective views of the microwave oven of a dual feed type as disclosed in U.S. Pat. No. 5,057,660, the oven comprises a cavity 201 having a pair of upper and lower microwave feed openings 206*a*, 206*b* formed in one side wall thereof; a pair of upper and lower heaters 202, 202 disposed in the cavity 201; a plurality of pairs of racks 204 formed at different spacings on the opposite side wall surfaces of the cavity 201 to allow a shelf 203 to be adjustable supported at selected height depending upon the size of a loading or a food to be placed on the shelf; and a planar cover plate 209 attached to the outer wall surface of the cavity 201 opposed to the racks 204 between the upper and lower feed openings 206*a*, 206*b* to permit easy production of standing waves in a waveguide 205.

The waveguide 205 for guiding microwaves generated by a magnetron 207 is mounted on the outer wall surface of the cavity 201 to cover all of the microwave feed openings 206*a*, 206*b* and cover plate 209, and the magnetron 207 is mounted on the outer surface of one wall of the waveguide 205 with a protruding antenna 208 thereof inserted into the waveguide. This microwave oven is usually referred to as a multifunctional microwave oven having both an electric heater heating function and a microwave heating function.

In operation of the microwave oven thus constructed, when it is desired to cook a food product by using the heaters, a heater mode is selected, and then electric power is applied to the oven in the state in which the food product is placed on the shelf 203 supported by the racks 204. As a result, the upper and lower heaters 202, 202 disposed in the cavity 201 are energized to heat the food product.

Then, when it is desired to cook a food product by using microwaves, a microwave mode is selected, and then electric power is applied to the oven. As a result, the magnetron 207 generates microwaves, which are in turn emitted upon the food in the cavity 201 through the upper and lower microwave feed openings 206*a*, 206*b* to dielectrically heat the food.

This microwave oven of a dual feed type is however disadvantageous in that since the waveguide 205 becomes longer and the separate cover plate 209 must be attached to the outer surface of the wall of the cavity 201 to permit the production of the standing waves in the waveguide 205, material costs and the number of manufacturing processes are increased, resulting in higher manufacturing cost. In addition, since a short circuited surface is not provided between the antenna 208 of the magnetron 207 and one side surface of the waveguide 205, the standing waves are not sufficiently produced in the waveguide, so that the output and uniform heating performance of the oven may be lowered.

Then, referring to FIGS. 3*a* and 3*b* showing longitudinal cross-sectional and schematic perspective views of the microwave oven as disclosed in European Patent Publication No. 0,478,053, the oven comprises a vertically extending waveguide 105 formed integrally with one side wall of a cavity 101 and having a protruding portion 104 formed at the upper portion of its outer wall and upper and lower microwave feed openings 106*a*, 106*b* formed in the upper and lower portions of its inner wall to be in communication with the interior of the cavity; and a magnetron 107 having an antenna 108 and mounted on the protruding portion 104 of the waveguide 105 with the antenna inserted into the protruding portion in spaced apart relation to the portion to form therebetween a short circuited surface. The width of the protruding portion 104 of the waveguide is chosen to be substantially equal to the length of the antenna 108, and the waveguide 105 is provided with a horizontal top wall 105*a* and an inclined lower wall 105*b*. Further, the distance between the upper and lower microwave feed openings 106*a*, 106*b* is chosen to become as great as possible such that the upper and lower feed openings are located near to the upper and lower ends of the waveguide 105, respectively.

With this construction, when the microwave oven is turned on, the microwaves generated by the magnetron 107 and emitted through the antenna 108 produce standing waves in the waveguide 105 through the protruding portion 104 of the waveguide short-circuited with the antenna, and then are in part emitted directly into the cavity 101 through the upper microwave feed opening 106*a* of the waveguide, while the remainder are reflected from the inclined lower wall 105*b* of the waveguide, and then emitted into the cavity through the lower microwave feed opening 106*b*. As a result, an interference field is formed in the cavity so that the food in the cavity can be heated uniformly.

However, this prior art microwave oven also has drawbacks in that since the waveguide 105 becomes longer to provide the great distance between the upper and lower microwave feed openings 106*a*, 106*b* and the protruding portion 104 must be additionally provided on the outer wall of the waveguide to form the short circuited surface for producing the standing waves in the waveguide, the waveguide is relatively complex in construction, resulting in increasing the number of manufacturing processes, and hence manufacturing cost. Further, the long waveguide leads to difficulty in arranging the parts of an electric apparatus in a space below the waveguide adjacent one side wall of the cavity during assembling operation.

SUMMARY OF THE INVENTION

With the foregoing drawbacks of the prior art microwave ovens in view, it is an object of this invention to provide a wave guide system of a microwave oven, which provides improved heating performance to allow a food in a cavity of the oven to be heated more uniformly and which is provided with a shortened waveguide to permit easy arrangement of the parts of an electric apparatus for the oven.

To achieve the above object, there is provided according to one form of this invention a wave guide system of a microwave oven comprising a cavity containing a food to be cooked and having a pair of microwave feed openings formed in one wall thereof; a magnetron having an antenna and positioned between the microwave feed openings in spaced apart relation to the wall having the feed openings, to generate microwaves having a frequency of $\lambda_g$; and a waveguide provided to cover the microwave feed openings, support thereon the magnetron and guide the microwaves through the microwave feed openings into the cavity and having a short circuited surface which is spaced apart from the antenna by a distance of $\lambda_g/4$ and parallel to the antenna.

DESCRIPTION OF THE PREFERRED EMBODIMENTS

The invention will now be described in detail, by way of example, with reference to FIGS. 4 to 10 of the accompanying drawings.

First Embodiment

Figure 1A:
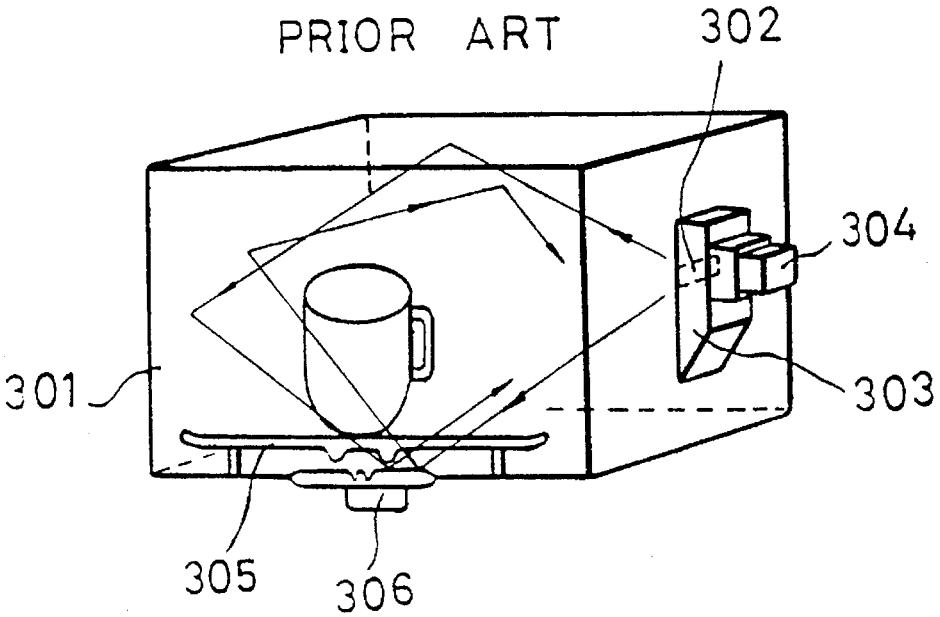
F I G. 1a PRIOR ART
FIGS. 1*a* and 1*b* are schematic perspective and longitudinal cross-sectional views of a prior art microwave oven of a single feed type.
Figure 1B:
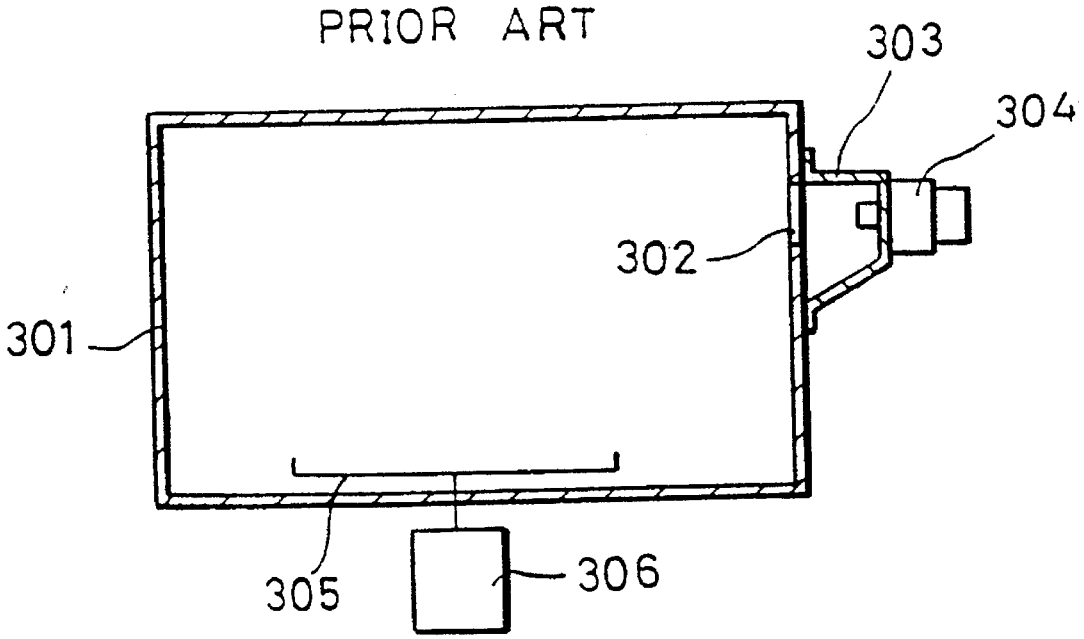
F I G. 1b PRIOR ART
Figure 2A:
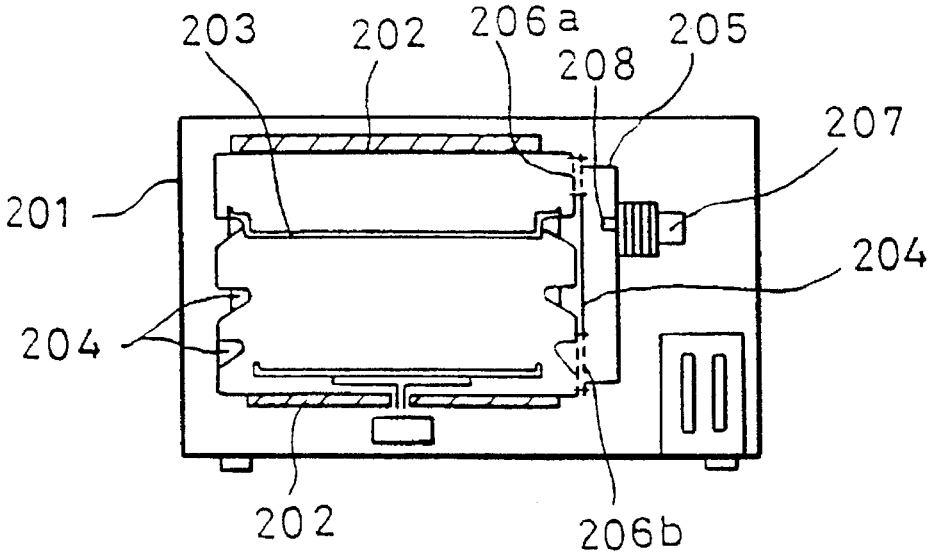
F I G. 2a PRIOR ART
FIGS. 2*a* and 2*b* are longitudinal cross-sectional and exploded fragmentary perspective views showing one example of a prior art microwave oven of a dual feed type.
Figure 2B:
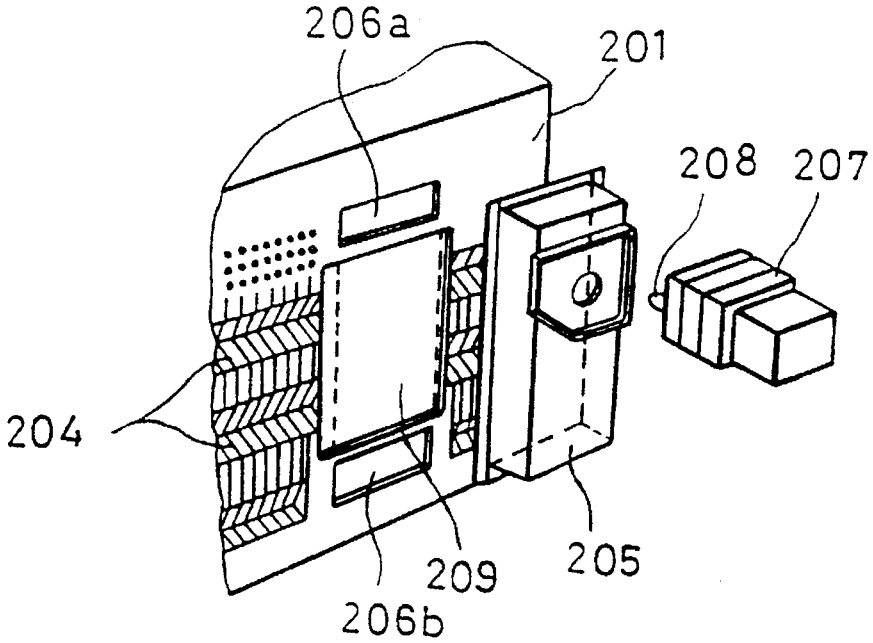
F I G. 2b PRIOR ART
Figure 3A:
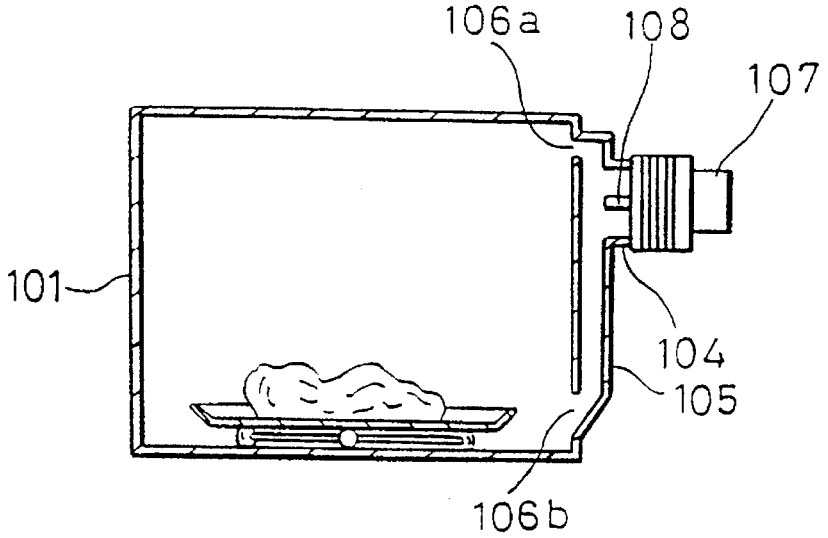
F I G. 3a PRIOR ART
FIGS. 3*a* and 3*b* are longitudinal cross-sectional and schematic perspective views showing another example of a prior art microwave oven of a dual feed type.
Figure 3B:
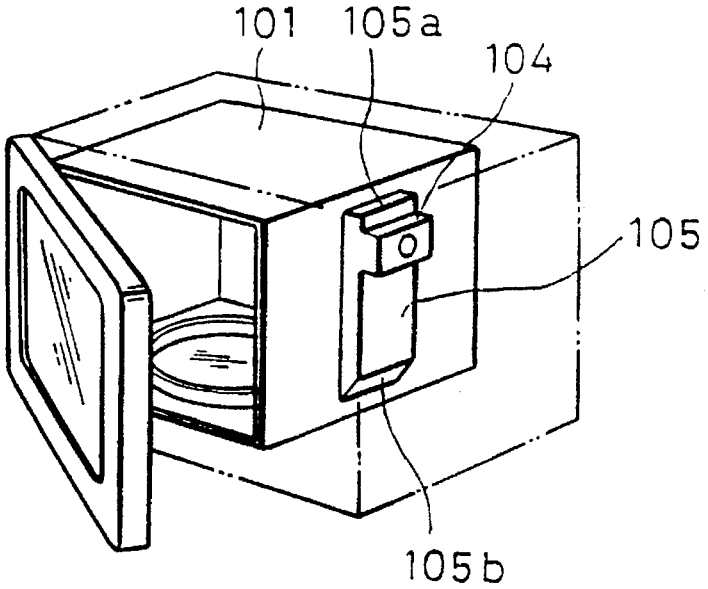
F I G. 3b PRIOR ART
Figure 4:
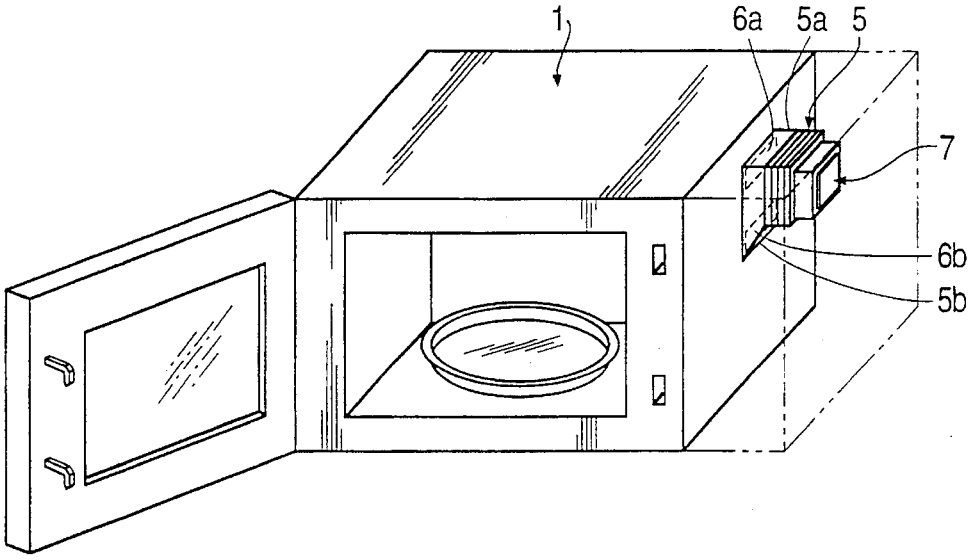
FIG. 4 is a perspective view of the microwave oven of a dual feed type according to one embodiment of this invention.
Figure 5:
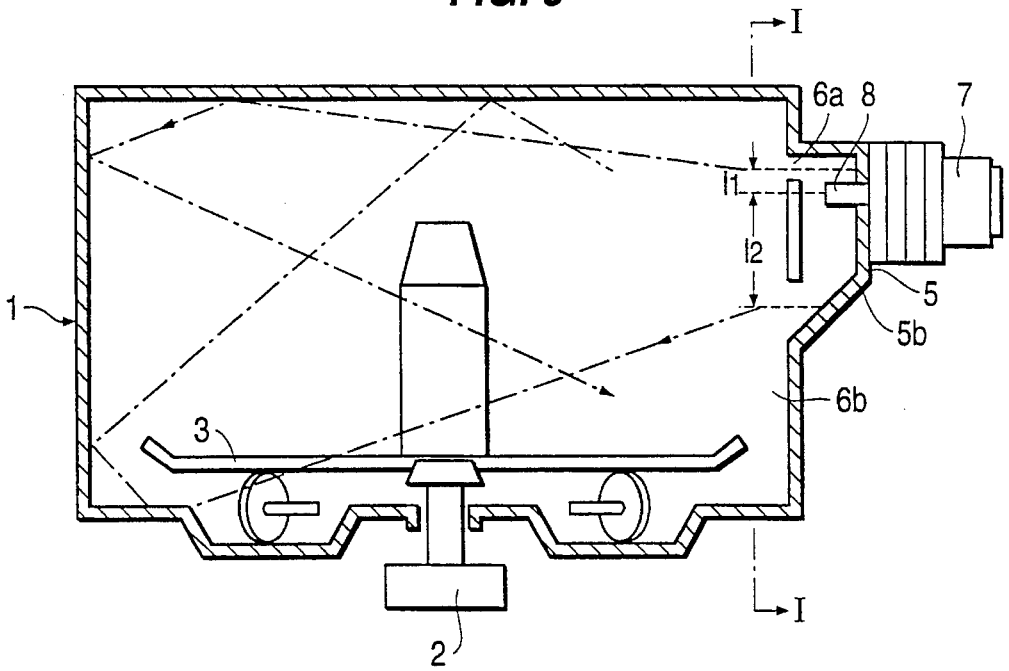
FIG. 5 is a longitudinal cross-sectional view of the oven of FIG. 4.

Referring to FIGS. 4 to 6 showing in perspective and cross section the microwave oven of a dual feed type according to the first embodiment of this invention, a wave guide system of the microwave oven according to this embodiment comprises a cavity 1 containing a food to be cooked and having a pair of upper and lower microwave feed openings 6*a*, 6*b* formed in one side wall thereof; a magnetron 7 having an antenna 8 and positioned between the microwave feed openings 6*a*, 6*b* in spaced apart relation to the side wall having the feed openings, to generate microwaves having a frequency of $\lambda_g$; and a waveguide 5 provided on the side wall of the cavity 1 to cover the feed openings 6*a*, 6*b*, support thereon the magnetron 7 and guide the microwaves through the feed openings into the cavity and having a short circuited surface which is spaced apart from the antenna 8 by a distance of $\lambda_g/4$ and parallel to the antenna.

The upper microwave feed opening 6*a* is formed in the upper portion of the side wall of the cavity 1, and the lower microwave feed opening 6*b* is formed in the middle portion of the same side wall. Although the microwave feed openings are preferably of a rectangular shape, they may be or polygonal or any other suitable shapes.

Figure 6A:
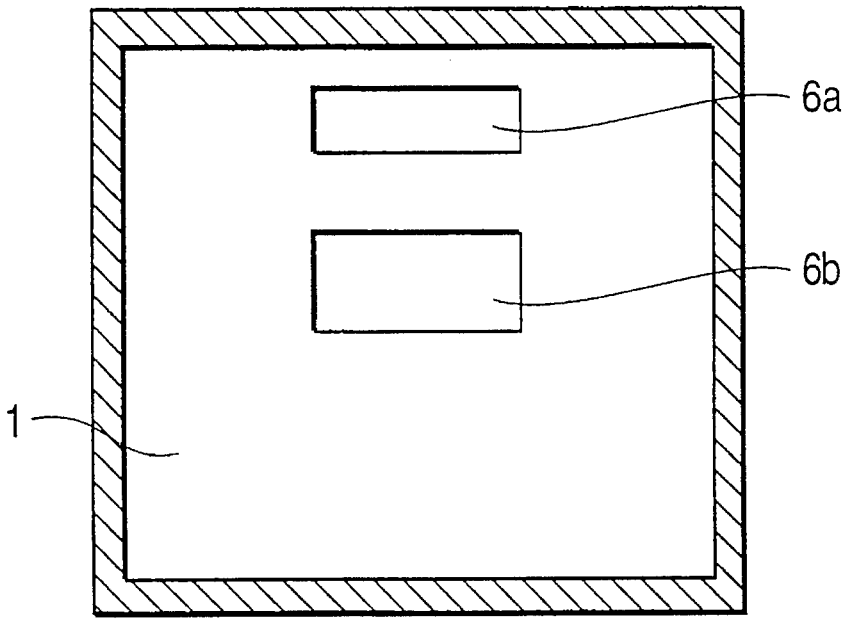
FIG. 6*a* is a cross-sectional view taken along line I—I of FIG. 5.

In addition, as shown in FIGS. 5 and 6*a*, the upper and lower microwave feed openings 6*a*, 6*b* of the side wall of the cavity 1 are formed such that the upper feed opening 6*a* is positioned adjacent to the antenna 8 of the magnetron 7 closer than the lower feed opening 6*b* and has an opening area smaller than that of the lower feed opening. The purpose of forming the feed openings 6*a*, 6*b* to have different sizes is to permit the microwaves emitted into the openings to form electric field of uniform intensity. More specifically, in case that two microwave feed openings are formed in the portions of the cavity 1 corresponding to the opposite ends of the waveguide 5, since the distances from the antenna 8 of the magnetron to the opposite ends of the waveguide are different from each other, the microwave feed openings must have different opening areas so as to obtain electric field of uniform intensity. In other words, to obtain uniform intensity of electric field of the microwaves supplied into the two microwave feed openings formed in the different portions of the cavity, the upper feed opening 6*a* positioned in close proximity to the antenna 8 of the magnetron 7 must be formed to have a smaller opening area, while the lower feed opening 6*b* positioned far from the antenna must be formed to have a larger area.

Figure 6B:
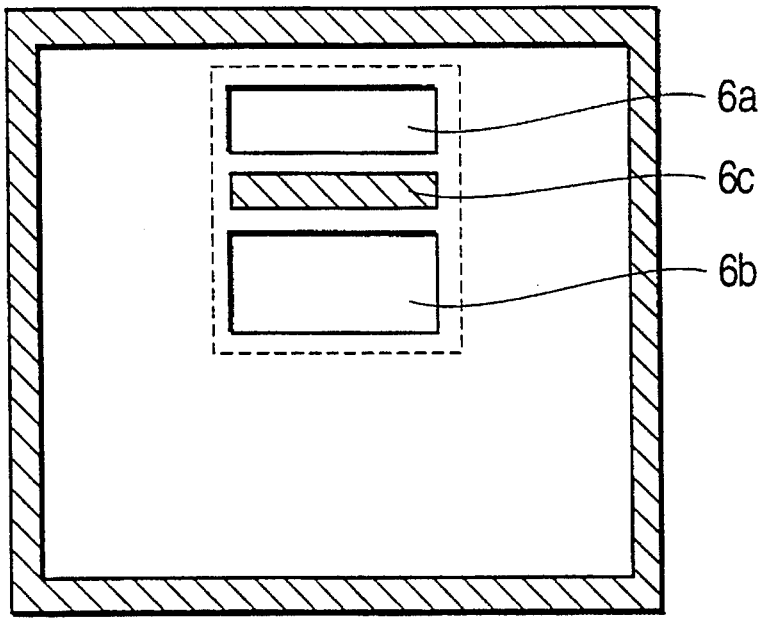
FIG. 6*b* is a view showing a modification of the microwave feed opening of FIG. 6*a*.

At least one additional microwave feed opening 6*c* may be formed of the cavity wall between the pair of the microwave feed openings 6*a*, 6*b* according to open area ratio of the upper and lower feed openings, as shown in FIG. 6*b*.

The waveguide 5 for guiding the microwaves is mounted externally of the upper portion of the side wall of the cavity 1 to encompass both of the upper and lower microwave feed openings 6*a*, 6*b* and is of a rectangular prismatic body having a rectangular cross section and is of a hexahedral shape having an inclined lower wall 5*b* opposite to a horizontal upper wall 5*a*, the short circuited surface. With this construction of the waveguide, the microwaves emitted into the cavity through the upper microwave feed opening are indirectly incident upon the food placed on a rotary tray 3 which is disposed on the bottom of the cavity to be rotatably driven by a motor 2 while the microwaves emitted into the cavity through the lower microwave feed opening are directly incident upon the food on the tray 3 through reflection from the inclined lower wall 5*b* of the waveguide.

The magnetron 7 for generating the microwaves and emitting them through the antenna 8 is mounted on the back of the waveguide 5 with the antenna protruded into the waveguide. At this time, as shown in FIG. 5, the mounting position of the antenna 8 of the magnetron is determined such that the distance 1 between the antenna and the horizontal upper wall 5*a* of the waveguide this equal to the value of $\lambda_g/4$. As a result, a short circuited surface is provided to produce standing waves in the waveguide during oscillation of the magnetron. When the distance 1 from the antenna of the magnetron to one end of the waveguide has the value of $\lambda_g/4$ such that the end of the waveguide forms the horizontal, short-circuited surface, the distance between the antenna and the other end of the waveguide usually has the value of more than $\lambda_g/4$. Therefore, according to this invention, the minimum length of the waveguide is $\lambda_g/2$, and the maximum length of the waveguide may be up to the length subtracted the height of the parts of an electric apparatus, such as a high voltage transformer (HVT), a high voltage capacitor (HVC) and the like (not shown), from the height of the side wall of the cavity, as in the prior arts. That is, the length of the waveguide of this invention is in the range of $\lambda_g/2$ to the value of the height of the electric apparatus subtracted from the height of the side wall of the cavity. Here, $\lambda_g$ is a wavelength of the microwaves generated in the magnetron.

Operation of the thus constructed microwave oven of this invention will now be described with reference to FIGS. 4 and 5.

When electric power is applied to the oven to operate it, the microwaves generated by the magnetron 7 are emitted into the waveguide 5 through the antenna 8, and then guided along the waveguide. Then, the microwaves in part pass through the upper microwave feed opening 6*a*, are reflected from the inner wall surfaces of the cavity 1, and then indirectly incident upon the food placed on the rotating tray 3, while the remainders are reflected from the inclined lower surface of the waveguide, pass through the lower microwave feed opening 6*b*, and then are directly incident upon the food. As a result, an interference field is formed in the cavity, thereby dielectrically heating the food.

At this time, the short circuited surface formed between one side wall of the waveguide 5 and the antenna 8 of the magnetron 7 permits easy production the standing waves to enhance the output and the uniform heating performance of the oven and the shortened length of the waveguide 5 mounted on the upper portion of one side wall of the cavity 1 permits easy arrangement of the parts of the electric apparatus below the waveguide. Further, since the waveguide can be formed to have a length equal to the length of the waveguide for the prior art microwave oven of single feed type having a single microwave feed opening, the waveguide can be used in common in both of the ovens of the prior art and this invention.

Furthermore, since the oven of this invention does not require a separate planar cover plate disposed on the outer surface of one side wall of the cavity, or a protruding portion provided at the waveguide to produce the standing waves as disclosed in U.S. Pat. No. 5,057,660 and European Patent Publication No. 0,478,053 set forth above, material costs and the number of manufacturing processes can be reduced, resulting in a lowering of manufacturing cost.

In addition, since the microwaves passed through the upper and lower microwave feed openings 6*a*, 6*b* are evenly incident upon the food in the cavity, and at the same time form the interference field in the cavity, thereby dielectrically heating uniformly the food, the oven of this invention can overcome the problems caused by the prior art microwave oven of a single feed type. That is, the microwave oven of this invention can not only achieve uniform heating of the thin, planar food products, but also eliminate as heating temperature difference between the upper and lower areas of a container having a given height when heating the food product contained in the container. According to this invention, therefore, since it is not necessary to additionally heat the areas of the food which have not been cooked due to nonuniform heating, the need for extension of a cooking time and an increase in power consumption can be eliminated.

To ascertain the effects of this invention as set forth above, experiments have been made on the uniform heating performance of the microwave oven. The results will now be explained with reference to FIGS. 9*a*, 9*b*, 10*a* and 10*b*.

Figure 9A:
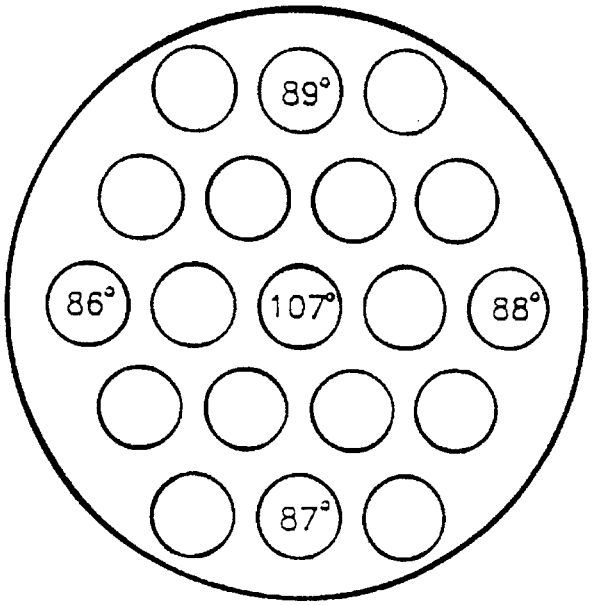
FIGS. 9*a* and 9*b* are diagrams showing temperature distributions when experimentally heating biscuits by using the prior art microwave oven of a single feed type and the microwave oven of a dual feed type of this invention, respectively.
Figure 9B:
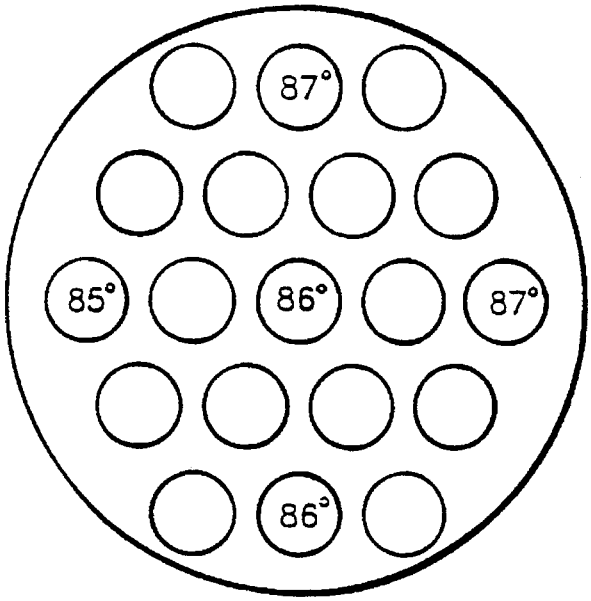

Reference is first made to FIGS. 9*a* and 9*b* which are diagrams showing temperature distributions in biscuits heated for the same period of time using the prior art microwave oven of a single feed type and the microwave oven of a dual feed type according to the first embodiment of this invention, respectively. When the biscuit was heated by using the prior art microwave oven, as shown in FIG. 9*a*, there was presented a phenomenon in which the temperatures of the respective areas of the biscuit are not uniform and particularly the central area has the highest temperature, thereby being burnt black. This phenomenon indicates that the microwaves are concentrated on the central area so that the entire biscuit is not heated uniformly. On the other hand, when the biscuit was heated using the microwave oven of this invention, as shown in FIG. 9*b*, the temperature distribution in the entire biscuit was substantially uniform so that the central area of the biscuit was not burnt. This indicates that the microwaves are evenly incident upon the biscuit.

Figure 10A:
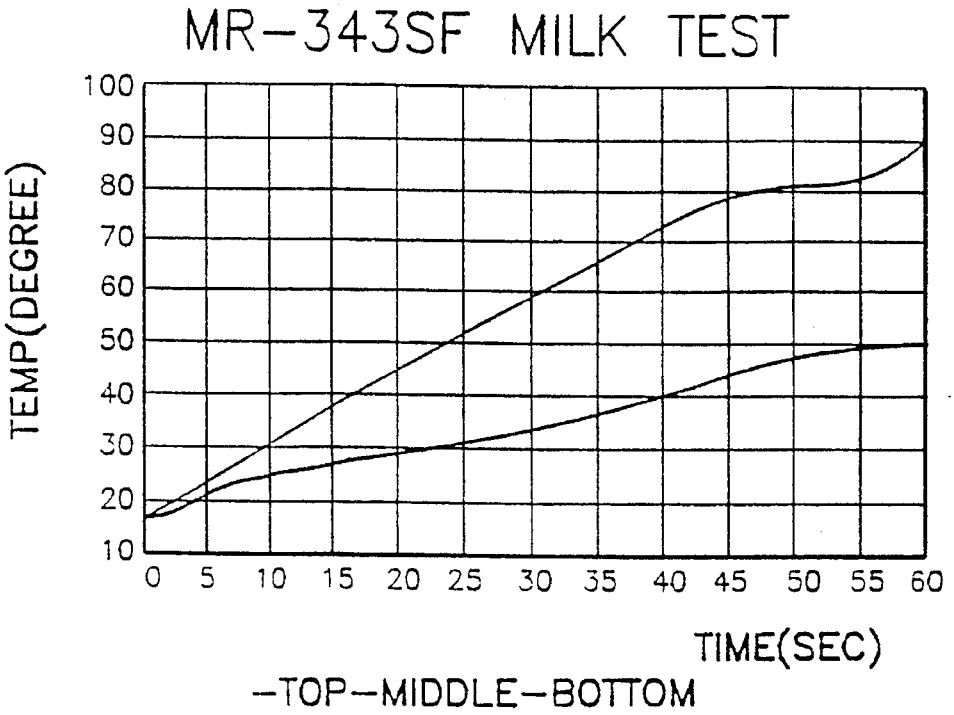
FIG. 10a prior art
FIGS. 10*a* and 10*b* are graphs showing temperature distributions when experimentally heating bottled milk by using the prior art microwave oven of a single feed type and the microwave oven of a dual feed type of this invention.
Figure 10B:
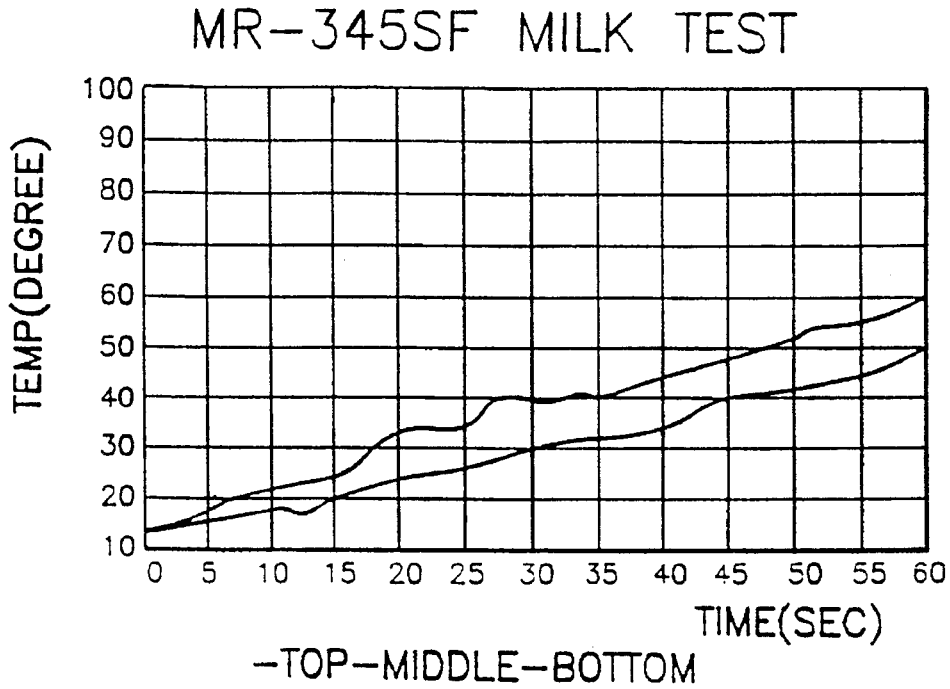

Referring to FIGS. 10*a* and 10*b* which are graphs showing temperature changes with time respective areas of milk bottles when heated by using the prior art microwave oven of a single feed type and the microwave oven of a dual feed type according to the first embodiment of this invention, respectively, the prior art microwave oven exhibits a heating patten in which the rate of a temperature rise with time in the upper portion of the milk bottle is increased more steeply than those in the middle and lower portions, as shown in FIG. 10*a*. As will be appreciated by those skilled in the art, this indicates that the microwaves are not evenly incident upon all of the upper, middle and lower portions of the milk bottle, so that uniform heating is not achieved.

On the other hand, according to this invention, as shown in FIG. 10*b*, the rates of a temperature rise in the upper, middle and lower portions of the milk bottle become substantially equal to one another. This shows that the microwaves are evenly incident upon all of the portions.

Second Embodiment

Figure 7A:
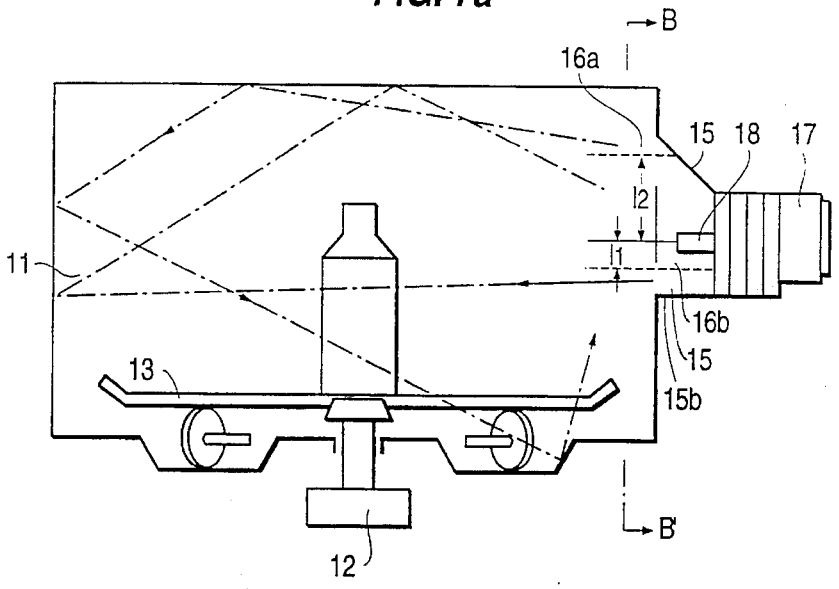
FIG. 7*a* is a longitudinal cross-sectional view of the microwave oven of a dual feed type according to another embodiment of this invention.
Figure 7B:
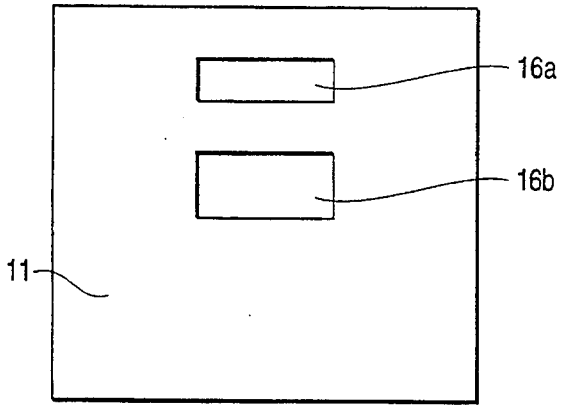
FIG. 7*b* is a cross-sectional view taken along the line B—B of FIG. 7*a*.
Figure 7C:
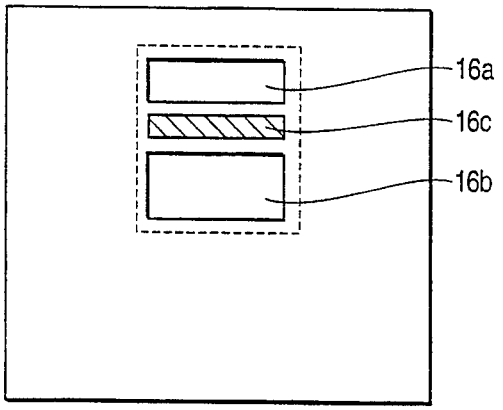
FIG. 7*c* is a view showing a modification of the microwave feed opening of FIG. 7*b;*

As shown in FIGS. 7*a*, 7*b*, and 7*c* showing in section the second embodiment of this invention, this embodiment is substantially identical in general construction and operation with the previous embodiment in that the oven of this embodiment also comprises a cavity containing a food to be cooked and having a pair of microwave feed openings formed in one wall thereof, a magnetron having an antenna and positioned between the microwave feed openings in space apart relation to the wall having the feed openings, to generate microwaves having a frequency of $\lambda_g$, and a waveguide provided to cover the microwave feed openings, support thereon the magnetron and guide the microwaves through the feed openings into the cavity and having a short circuited surface which is spaced apart from the antenna by a distance of $\lambda_g/4$ and parallel to the antenna. Therefore, no further detailed explanation will be required.

However, this embodiment is different from the first embodiment in that the upper and lower microwave feed openings 16*a*, 16*b* of the cavity 11 are formed such that the upper feed opening 6*a* has an opening area larger than that of the lower feed opening 16*b*, and that the waveguide 15 is formed to have an inclined upper wall 15*a* and a horizontal lower wall 15*b* forming to have an inclined upper wall 15*a* and a horizontal lower wall 15*b* forming the short circuited surface which is spaced apart from the antenna 18 of the magnetron 17 by a distance of $\lambda_g/4$ and parallel to the antenna. Stating in brief, the differences between this embodiment and the first embodiment are that the waveguide 15 is in the form in which the waveguide of the first embodiment is positioned upside down, and the lower feed opening 16*b* is formed smaller than the upper feed opening 16*a* and disposed adjacent the antenna 18 of the magnetron 17 in contrast to the first embodiment.

With this construction, as shown in FIG. 7*a*, the microwaves introduced into the waveguide 16 during oscillation of the magnetron 17 pass in part through the lower feed opening 16*b*, and then directly incident upon a food on the rotary tray 13 disposed in the cavity 11 to be rotatably driven wall 15*a* of the waveguide, and then indirectly incident upon the food through the upper feed opening 16*a*. FIG. 7*c* shows an additional microwave feed opening 16*c* formed of the cavity wall between the pair of the microwave feed openings 16*a*, 16*b*.

Third Embodiment

Figure 8A:
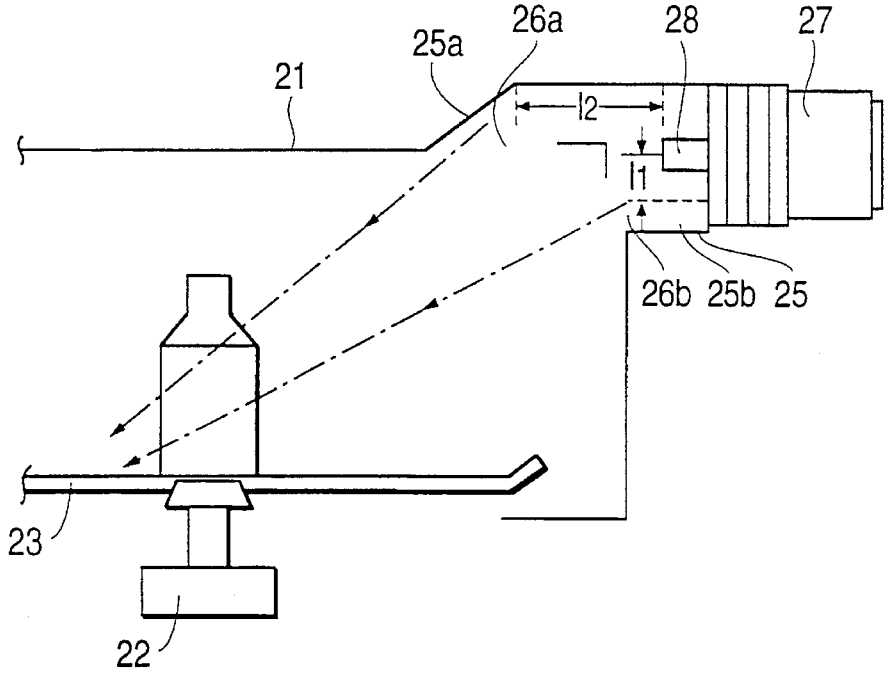
FIG. 8*a* is a longitudinal cross-sectional view of the microwave oven of a dual feed type according to yet another embodiment of this invention.
Figure 8B:
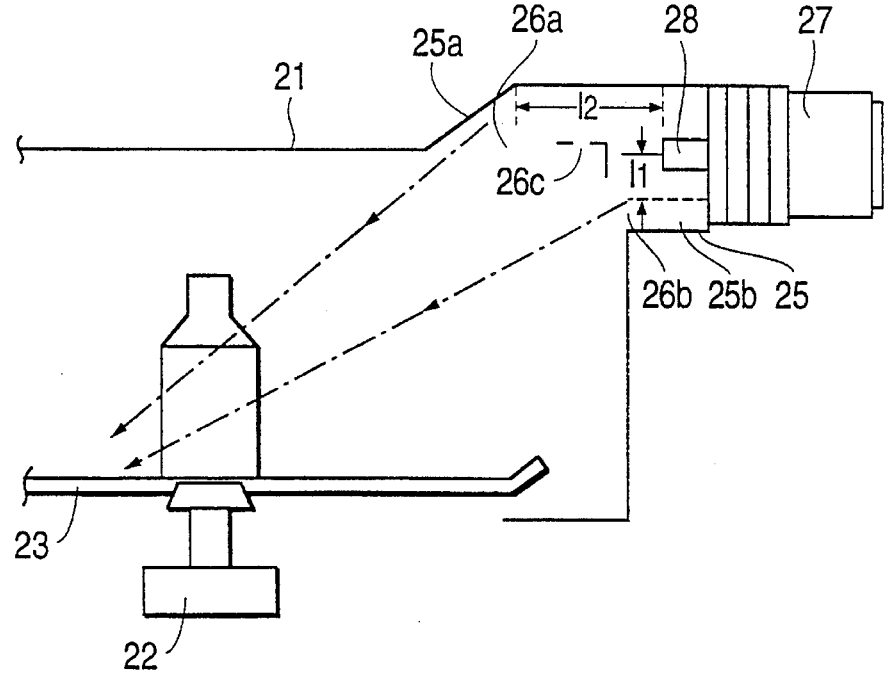
FIG. 8*b* is a view showing a modification of the microwave feed opening of FIG. 8*a*.

In FIG. 8*a* and 8*b*, there is shown in longitudinal section the microwave oven of a dual feed type according to the third embodiment of this invention. This embodiment is substantially identical with the previous embodiments in that the oven of this embodiment comprises a cavity having a pair of microwave feed openings, a magnetron for generating microwaves, and a waveguide disposed to interconnect the cavity and the magnetron and be in communication with the microwave feed openings. Therefore, its detailed description will be omitted to avoid the duplication of explanation.

However, this embodiment is different from the first and second embodiments in that one of the microwave feed openings, 26*a*, is formed in one side portion of the upper wall of the cavity 21, while the other 26*b* is formed in the upper end portion of one wall of the cavity adjacent the feed opening 26*a* of the upper wall, and that the waveguide 25 is of the configuration having a longitudinal cross section of an inverted L-shape to be joined to the cavity 21 so as to cover both of the microwave feed openings 26*a*, 26*b* formed in the upper and side walls of the cavity. FIG. 8*b* shows an additional microwave feed opening 26*c* formed of the cavity wall between the pair of the microwave feed openings 26*a*, 26*b*.

Further, differently from the first and second embodiments, the waveguide 25 of this embodiment has an inclined wall portion 25*a* provided at the end portion thereof joined to the upper wall of the cavity 21, and a horizontal lower wall 25*b* provided at the end portion thereof joined to the side wall of the cavity and providing a short circuited surface which is spaced apart from the antenna 28 of the magnetron 27 by a distance of $\lambda_g/4$ and parallel to the antenna.

Reference numerals 22 and 23 denote a motor and a tray, reference to various embodiments thereof, it will be understood that variations and modifications in form and detail may by made therein without departing from the spirit and scope of the invention as defined in the appended claims.

What is claimed is:

1. A wave guide system of a microwave oven comprising:

a cavity containing a food to be cooked and having a pair of microwave feed openings formed in one wall thereof;

a magnetron having an antenna and positioned between said microwave feed openings in spaced apart relation to said wall having said microwave feed openings, to generate microwaves having a wavelength of $\lambda_g$; and a waveguide provided to cover an external portion of said wall having said microwave feed openings, said external portion including said microwave feed openings, support thereon said magnetron and guide microwaves through said microwave feed openings into said cavity and having a short circuited surface which is spaced apart from said antenna by a distance of $\lambda_g/4$ and parallel to said antenna.

2. A wave guide system of a microwave oven as claimed in claim 1, wherein said waveguide has a length which is greater than $\lambda_g/2$.

3. A wave guide system of a microwave oven as claimed in claim 1, wherein sizes of said microwave feed openings are differ in proportion to a distance between said antenna and the centers of said microwave feed openings.

4. A wave guide system of a microwave oven as claimed in claim 1, wherein said waveguide is of a hexahedral shape having an inclined surface opposite to said short circuited surface.

5. A wave guide system of a microwave oven as claimed in claim 1, wherein said cavity further comprises at least one additional microwave feed opening between said pair of the microwave feed openings.

6. A wave guide system of a microwave oven as claimed in claim 5, wherein said waveguide has a length which is greater than $\lambda_g/2$.

7. A wave guide system of a microwave oven as claimed in claim 5, wherein sizes of said microwave feed openings differ in proportion to distances between said antenna and the centers of said microwave feed openings.

8. A wave guide system of a microwave oven as claimed in claim 5, wherein said waveguide is of a hexahedral shape having an inclined surface opposite to said short circuited surface.

9. A wave guide system of a microwave oven comprising:

a cavity containing a food to be cooked and having a pair of microwave feed openings which are formed one in each of two neighboring walls thereof;

a magnetron having an antenna and positioned between said microwave feed openings in spaced apart relation to said walls having said microwave feed openings, to generate microwaves having a wavelength of $\lambda_g$; and a waveguide provided to cover said microwave feed openings, support thereon said magnetron and guide the microwaves through said microwave feed openings into said cavity and having a short circuited surface which is spaced apart form said antenna by a distance of $\lambda_g/4$ and parallel to said antenna.

10. A wave guide system of a microwave oven as claimed in claim 9, wherein said waveguide has a length which is greater than $\lambda_g/2$.

11. A wave guide system of a microwave oven as claimed in claim 9, wherein sizes of said microwave feed openings differ in proportion to distances between said antenna and the centers of said microwave feed openings.

12. A wave guide system of microwave oven as claimed claim 9, wherein said waveguide is a hexahedral shape having an inclined surface opposite to said short circuited surface.

13. A wave guide system of microwave oven as claimed in claim 9, wherein said cavity further comprises at least one additional microwave feed opening between said pair of the microwave feed openings.

14. A wave guide system of a microwave oven as claimed in claim 13, wherein said waveguide has a length which is greater than $\lambda_g/2$.

15. A wave guide system of a microwave oven as claimed in claim 13, wherein said microwave feed openings differ in size in proportion to distances between said antenna and the centers of said microwave feed openings.

16. A wave guide system of a microwave oven as claimed in claim 13, wherein said waveguide is of a hexahedral shape having an inclined surface opposite to said short circuited surface.

* * * * *

UNITED STATES PATENT AND TRADEMARK OFFICE

CERTIFICATE OF CORRECTION

PATENT NO. : 5,567,339 Page 1 of 7

DATED : October 22, 1996

INVENTOR(S) : Joo, et al

It is certified that error appears in the above-identified patent and that said Letters Patent is hereby corrected as shown below:

The title page should be deleted and substitute therefor the attached title page.

Signed and Sealed this

Eighth Day of December, 1998

Bruce Lehman

*Attest:*

BRUCE LEHMAN

*Attesting Officer*

*Commissioner of Patents and Trademarks*

United States Patent [19]

Joo et al.

[11] Patent Number: 5,567,339

[45] Date of Patent: Oct. 22, 1996

[54] WAVE GUIDE SYSTEM OF A MICROWAVE OVEN

[75] Inventors: Phil D. Joo; Kyung S. Lim; Kwan H. Lee, all of Kyungsangnam-do, Rep. of Korea

[73] Assignee: Goldstar Co., Ltd., Seoul, Rep. of Korea

[21] Appl. No.: 64,421

[22] Filed: May 21, 1993

[30] Foreign Application Priority Data

Aug. 25, 1992 [KR] Rep. of Korea ..... 15981/1992
Mar. 8, 1993 [KR] Rep. of Korea ..... 3427/1993

[51] Int. Cl.[6] ..... H05B 6/72

[52] U.S. Cl. ..... 219/748; 219/746; 219/750; 219/697

[58] Field of Search ..... 219/10.55 F, 10.55 A, 219/10.55 R, 10.55 E, 746, 748, 750, 695, 696, 697

[56] References Cited

U.S. PATENT DOCUMENTS 4,616,119 10/1986 Shin ..... 219/10.55 F
4,733,037 3/1988 Nitta et al. ..... 219/10.55 F
5,015,813 5/1991 Yamada et al. ..... 219/10.55 F
5,057,660 10/1991 Yamada et al. .
5,177,333 1/1993 Ogasawara ..... 219/10.55 F
5,237,139 8/1993 Berg et al. ..... 219/10.55 A

FOREIGN PATENT DOCUMENTS 0478053 9/1991 European Pat. Off. .

*Primary Examiner*—Philip H. Leung
*Attorney, Agent, or Firm*—Fish & Richardson P.C.

[57] ABSTRACT

A wave guide system of a microwave oven is provided, comprising a cavity containing a food to be cooked and having a pair of microwave feed openings formed in one wall thereof; a magnetron having an antenna and positioned between the microwave feed openings in spaced apart relation to the wall having the feed openings, to generate microwaves having a wavelength of $\lambda_g$; and a waveguide provided to cover the feed openings, support thereon the magnetron and guide the microwave through the feed openings into the cavity and having a short circuited surface which is spaced apart from the antenna by a distance of $\lambda_g/4$ and parallel to the antenna. With this arrangement, the microwave generated in the magnetron produce standing waves in the waveguide, and then are emitted into the cavity through the microwave feed openings of the cavity, thereby uniformly heating a food in the cavity.

16 Claims, 9 Drawing Sheets

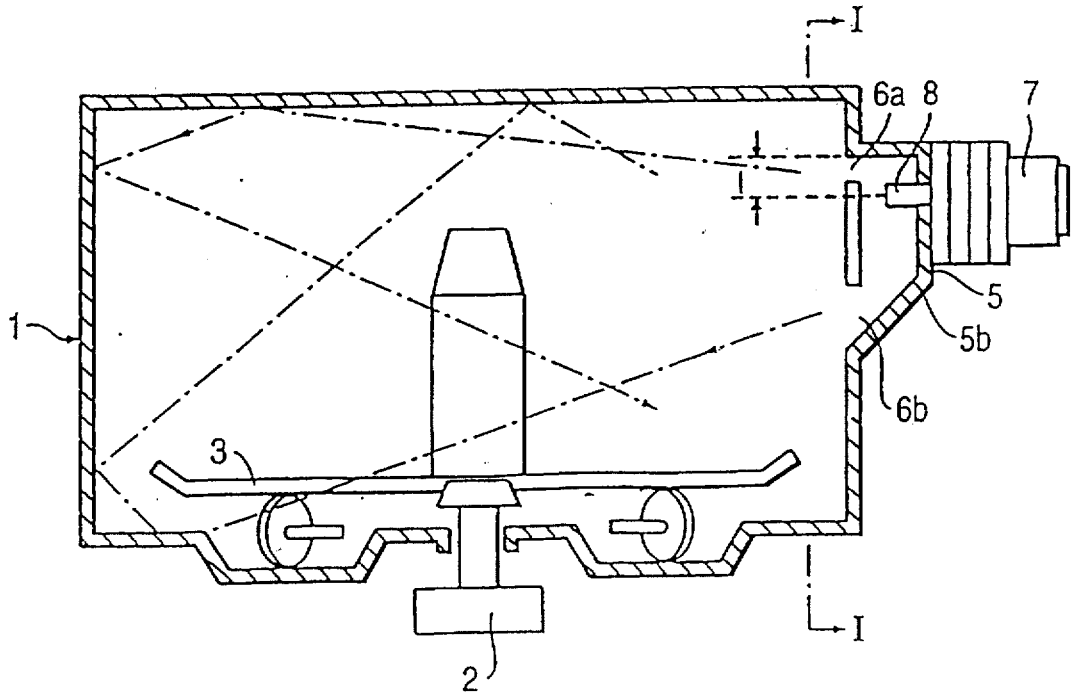

UNITED STATES PATENT AND TRADEMARK OFFICE

CERTIFICATE OF CORRECTION

PATENT NO.: 5,567,339

DATED: October 22, 1996

INVENTOR(S): Phil D. JOO et al.

It is certified that an error appears in the above-identified patent and that said Letters Patent is hereby corrected as shown below:

Column 5, line 50, "I" should read --l--.

Column 5, line 54, "I" should read --l--.

On the front page of the patent, delete the drawing, and replace it as follows:

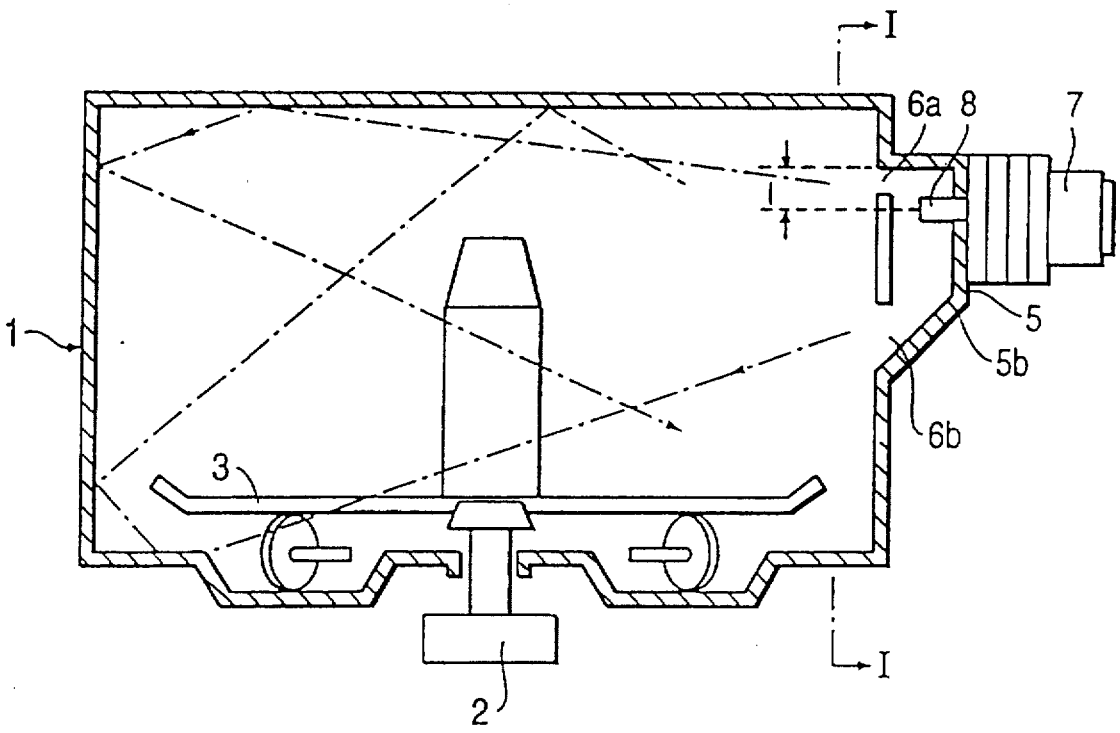

UNITED STATES PATENT AND TRADEMARK OFFICE

CERTIFICATE OF CORRECTION

PATENT NO.: 5,567,339

DATED: October 22, 1996

INVENTOR(S): Phil D. JOO et al.

It is certified that an error appears in the above-identified patent and that said Letters Patent is hereby corrected as shown below:

Delete Figure 5 of the patent, and replace it as follows:

FIG. 5

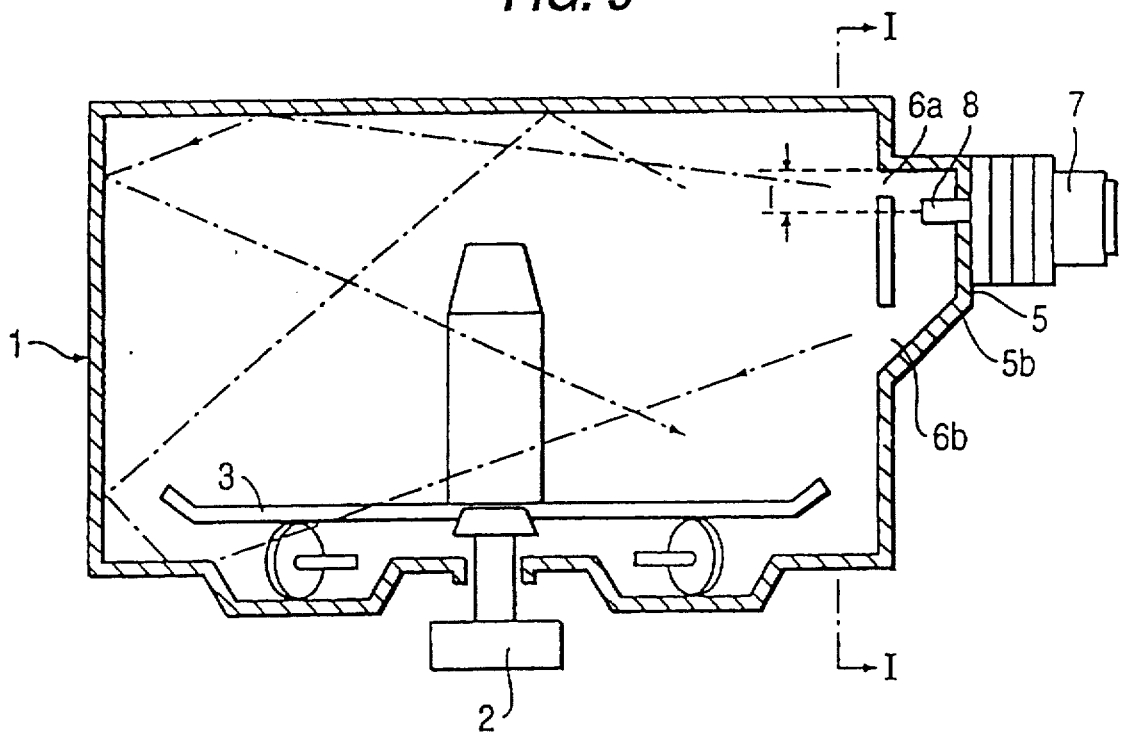

UNITED STATES PATENT AND TRADEMARK OFFICE

CERTIFICATE OF CORRECTION

PATENT NO.: 5,567,339

DATED: October 22, 1996

INVENTOR(S): Phil D. JOO et al.

It is certified that an error appears in the above-identified patent and that said Letters Patent is hereby corrected as shown below:

Delete Figure 7a of the patent, and replace it as follows:

FIG. 7a

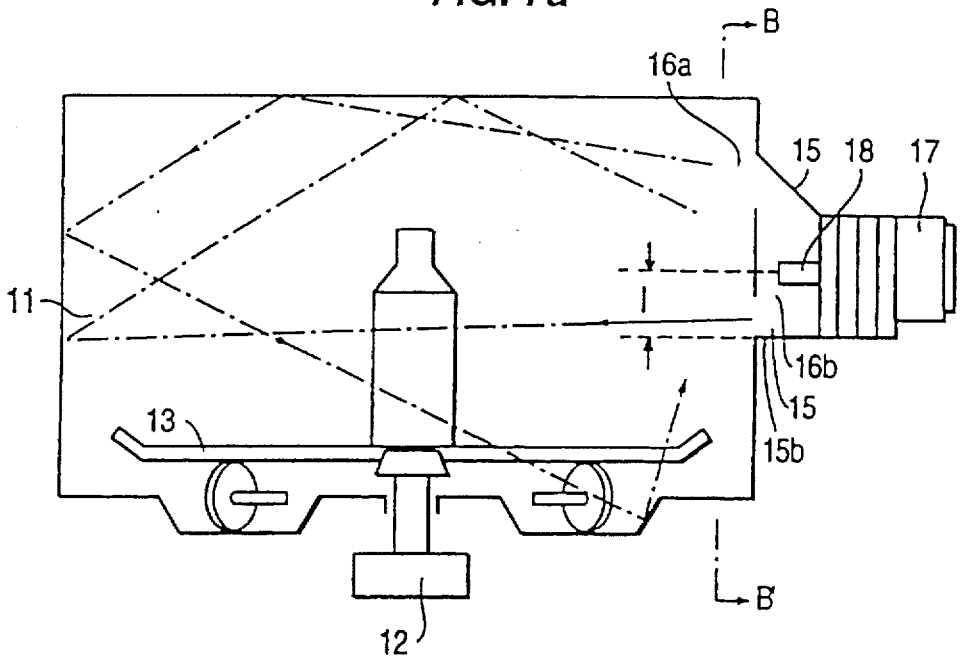

UNITED STATES PATENT AND TRADEMARK OFFICE

CERTIFICATE OF CORRECTION

PATENT NO.: 5,567,339

DATED: October 22, 1996

INVENTOR(S): Phil D. JOO et al.

It is certified that an error appears in the above-identified patent and that said Letters Patent is hereby corrected as shown below:

Delete Figure 8a of the patent, and replace it as follows:

*FIG. 8a*

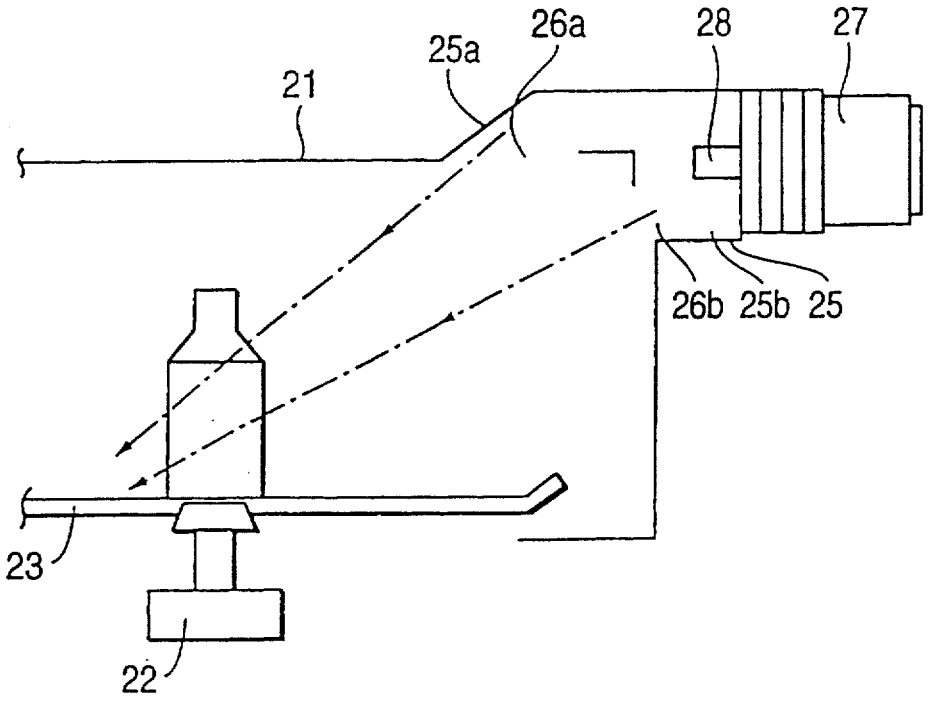

UNITED STATES PATENT AND TRADEMARK OFFICE

CERTIFICATE OF CORRECTION

PATENT NO.: 5,567,339

DATED: October 22, 1996

INVENTOR(S): Phil D. JOO et al.

It is certified that an error appears in the above-identified patent and that said Letters Patent is hereby corrected as shown below:

Delete Figure 8b of the patent, and replace it as follows:

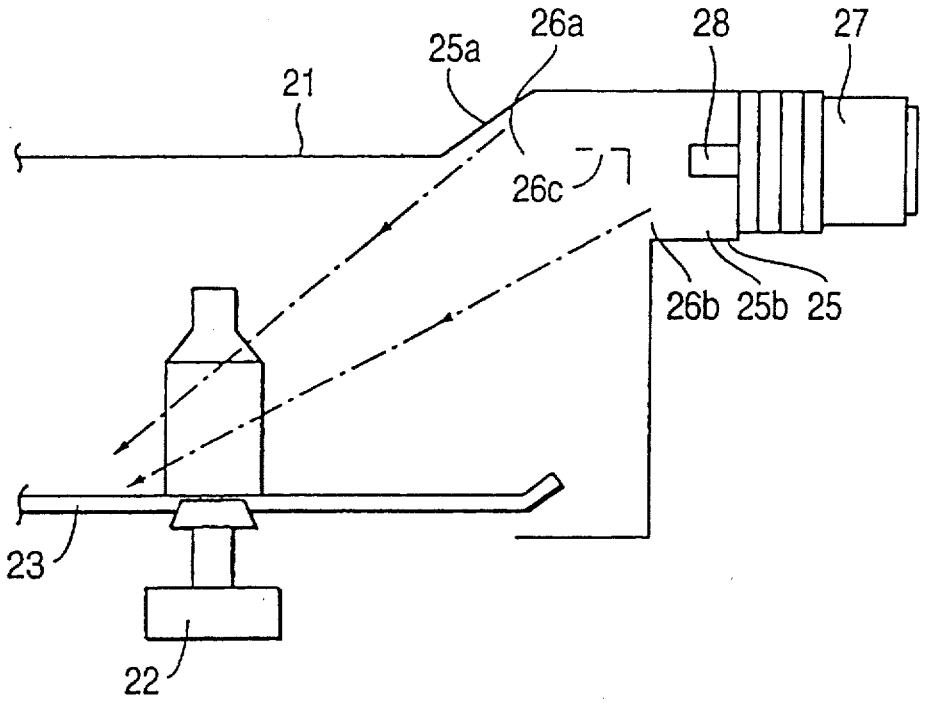

*FIG. 8b*